United States Patent [19]

Martens

[11] Patent Number: 4,582,386

[45] Date of Patent: Apr. 15, 1986

[54] CONNECTOR WITH ENLARGED POWER CONTACT

[75] Inventor: John D. Martens, Carrollton, Tex.

[73] Assignee: Elfab Corp., Lewisville, Tex.

[21] Appl. No.: 667,293

[22] Filed: Nov. 1, 1984

[51] Int. Cl.[4] ..... H01R 9/09

[52] U.S. Cl. ..... 339/176 M; 339/17 C; 339/19

[58] Field of Search ..... 339/176 M, 176 MP, 14 R, 339/14 P, 17 C, 17 M, 17 LM, 258 R, 262 R, 111, 19, 221 R, 221 M, 220 R

[56] References Cited

U.S. PATENT DOCUMENTS

| | | | |
|---|---|---|---|
| 3,543,226 | 11/1970 | Laboue | 339/221 M |
| 3,660,803 | 5/1972 | Cooney | 339/176 MP |
| 3,685,007 | 8/1972 | Riley et al. | 339/262 R |
| 3,865,462 | 2/1975 | Cobaugh et al. | 339/176 M |
| 3,888,559 | 6/1975 | Geib | 339/111 |
| 4,068,910 | 1/1978 | Brown et al. | 339/17 M |
| 4,136,917 | 1/1979 | Then et al. | 339/176 MP |
| 4,274,700 | 6/1981 | Keglewitsch et al. | 339/221 M |
| 4,275,944 | 6/1981 | Sochor | 339/176 MP |
| 4,418,972 | 12/1983 | Benasutti | 339/176 MP |

*Primary Examiner*—John McQuade

*Attorney, Agent, or Firm*—John E. Vandigriff

[57] ABSTRACT

A connector with one or more rows of contacts has enlarged contacts on each end of the connector to handle large currents. The enlarged contacts or power contacts maybe be either male or female type contacts whereas the male contact has two compliant press fit ends for press fitting into a circuit board and the female type contact is a two piece contact and has a tab end that is connected to the edge of a printed circuit board.

2 Claims, 15 Drawing Figures

CONNECTOR WITH ENLARGED POWER CONTACT

FIELD OF THE INVENTION

This invention relates to connectors and power contacts, and more particularly to press fit and card edge connectors having a plurality of power contacts for conducting large currents between a backpanel and circuit boards interconnected with the backpanels through said connectors.

BACKGROUND OF THE INVENTION

With the increasing complexity of backpanel designs it is necessary that the back panel be able to handle large amounts of current and to conduct these currents to a plurality of daughter boards. Buss hardware has been integrated into the backpanel by locating a layer of copper in the laminated structure of the backpanel. It has also been located on the top or bottom of the backpanel. When it has been located on the top or bottom of the backpanel, it usually consists of a strip of heavy copper extending along the surface and positioned adjacent to either the ends of mounted connectors or parallel to the connectors. Straps are then connected to the connector terminals to connected the desired terminals to the buss. When press fit terminals are used, the buss has to be on the bottom side of the back panel so as to be convenient to the connector terminals that extend through the panels.

The common practice has been to use standard connectors for either power or signal connections, with the selection of the power connections depending upon the placement of the buss. The maximum power normally carried by a mated contact pair is about 1 ampere, it is therefore necessary to connect contacts in parallel to handle higher power. With the use of standard connectors, it is necessary to adapt the connectors to a scheme of interconnection that joins several contact terminals to handle the higher power requirements.

The placement of the power busses is limited to areas adjacent to the ends of the connectors or parallel to the connectors. The joined contact terminals then have to be externally connected to the buss.

SUMMARY OF THE INVENTION

The invention is to a press fit connector which is to be installed on a back panel or a printed circuit mother board. In one embodiment of the invention, a press fit power contact is used to provide for a larger current supply than an ordinary single contact is able to supply.

Both male and female power connectors are used, and to provide for the power connection to a backpanel or buss bar, the power contact has an enlarged end or in some instances the contact has more than one current path interconnected with the back panel or buss bar.

Another feature of the invention is the provision for mounting the connector on a buss bar to interconnected several contacts of the connector to provide an even greater power handling capability then a single power contact would provide. The contacts of the connector are press fitted into the circuit board on which the connector is mounted or into a buss bar when the connector is the type to mount on a buss bar. The connector may be either male of female type and may be a multiple row connector with the contacts in line across the connector or in a staggered pattern.

The novel features of the invention and the technical advance represented thereby will readily understood from the following description of a preferred embodiment of the invention when read in conjunction with the claims and drawings in which:

BRIEF DESCRIPTION OF THE DRAWINGS

FIG. 2 is a cross sectional view taken through section 2—2 of FIG. 3*b;*

FIG. 4 is a cross section view taken through section 4—4 of FIG. 5*b;*

FIG. 6 is a sectional view taken through 6—6 of FIG. 8*a* and FIG. 7 is a section view taken through 7—7 of FIG. 8*a;*

DESCRIPTION OF THE PREFERRED EMBODIMENTS OF THE INVENTION

Figure 1:
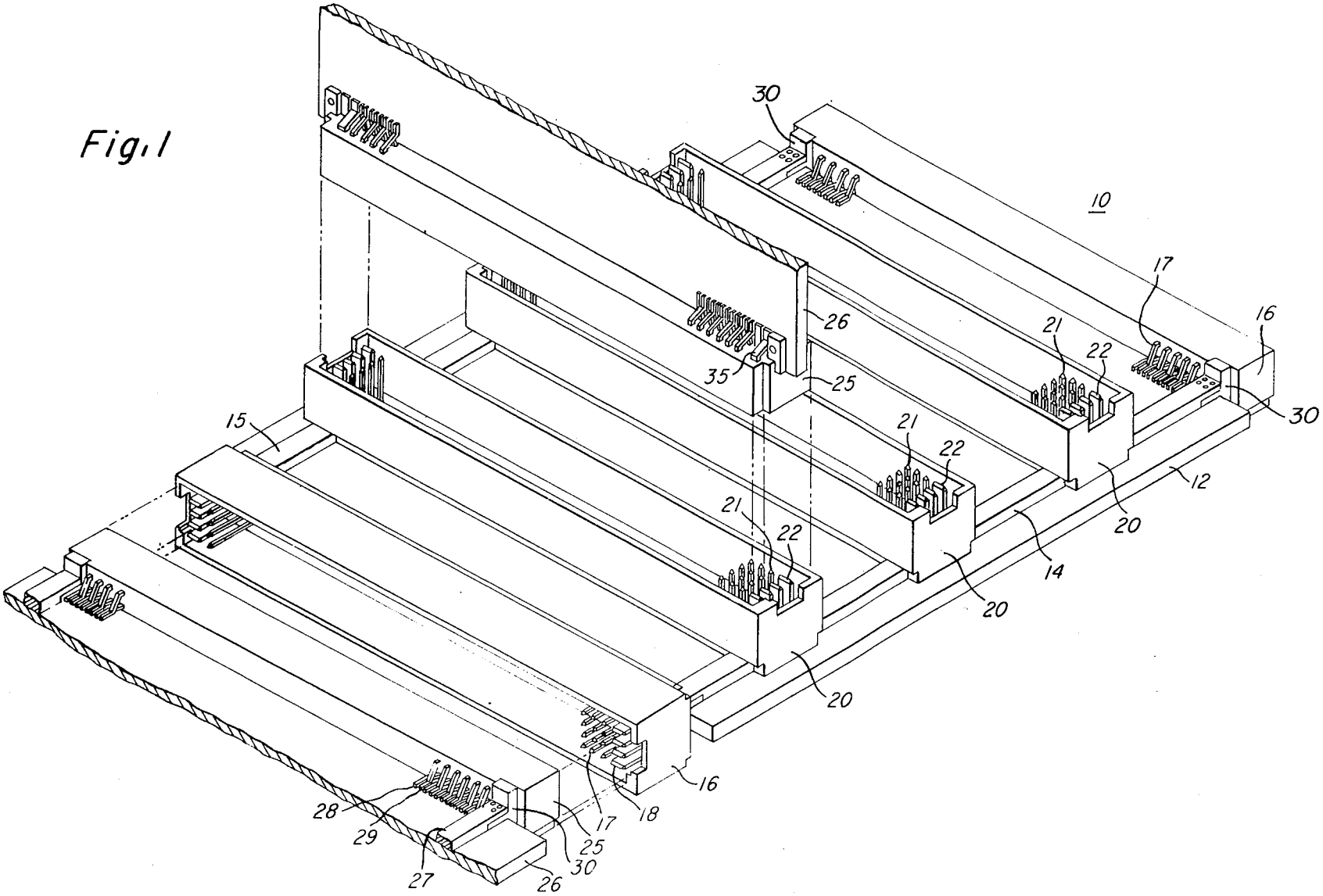
FIG. 1 illustrates a backpanel with both press fit and edge mount connectors of the present invention.

FIG. 1 illustrates a backpanel 10 with three male press fit connectors 20 mounted on the surface of circuit board 12 and card edge connectors 16 mounted on two edges. The surface mounted connectors 20 have buss bars 14 and 15 extending under each end of the connectors and connected to power pads 30 mounted on each end of the card edge connectors 16. Also illustrated are two circuit cards 26 with edge connectors 25, one of which mates with one of the surface mounted connector and the other of which mates with one of the edge connectors. Each connector type on the backpanel is more fully described below.

Connectors 20 have a plurality of male contacts 21 and 22. Contacts 21 are pin type press fit contacts while contacts 22 are power contacts and will be more fully described below.

The card edge connector 16 contacts are pin type contacts but are made to connect to the edged of a printed circuit board, as illustrate by board 12 [also card 26 and contacts 28 and 29] and contacts 17. Power contacts 18 in connector 16 are press fit type contacts.

Connector 25 has female contacts 28 and 29 to mate with the contacts in connector 16, and similar to the contacts in connector 16, are of the type to connect to the edge of a printed circuit board. Connector 25, shown mating with one of the connectors 20, has a power contact 35 that does not press fit into a power pad, but is connected directly to the circuit board.

Figure 2:
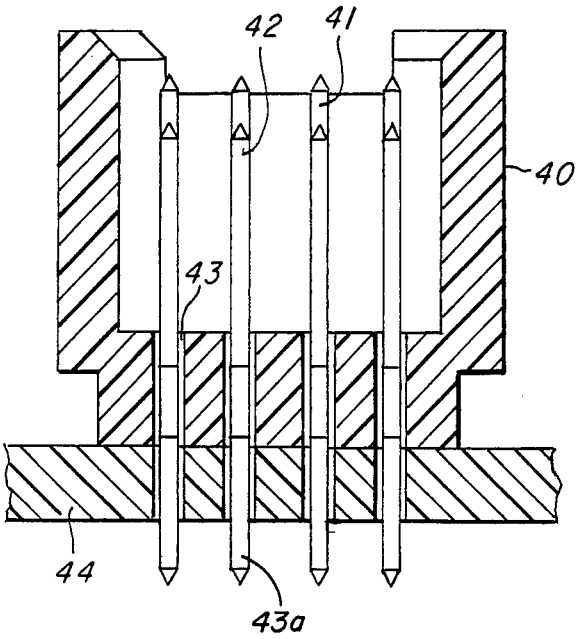
FIGS. 2, 3*a* and 3*b* illustrate one embodiment of a connector of the present invention.
Figure 3A:
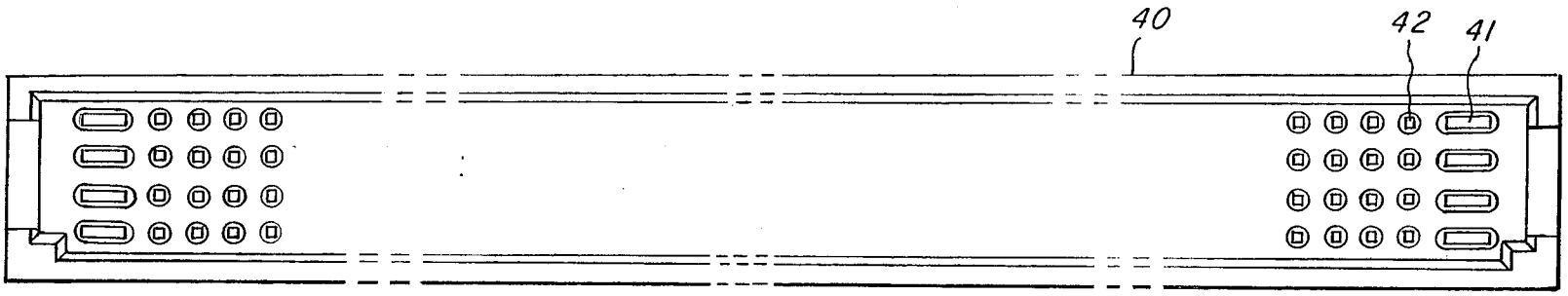
Figure 3B:
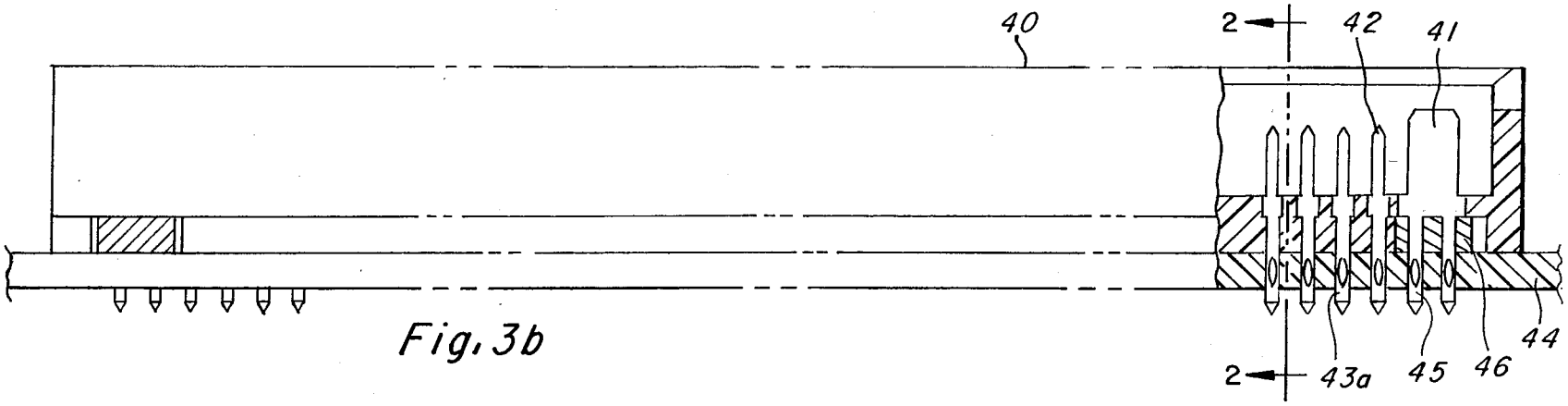

FIGS. 2 and 3*a* and 3*b* illustrate a male surface mount connector with press fit contacts. In FIG. 2, a cross sectional view of connector 40 is shown taken through section 2—2 of FIG. 3*b*. Connector 40 is has four rows of contacts, the majority of which are pin type press fit contacts 42, however, on each end of the connector is a row of power contacts 41.

Each contact extends through opening 43 in the bottom surface of the connector body. Contacts 42 are press fit into the circuit board 44. Power contacts 41 are first press fit into a buss bar 46 and then into the circuit board 44. Both types of connectors have a compliant end, end 45 for contact 41 and end 43*a* for contacts 42. It should be noted that power contact 41 may have two mounting ends 45 to enable the contact to handle its rated power.

Figure 4:
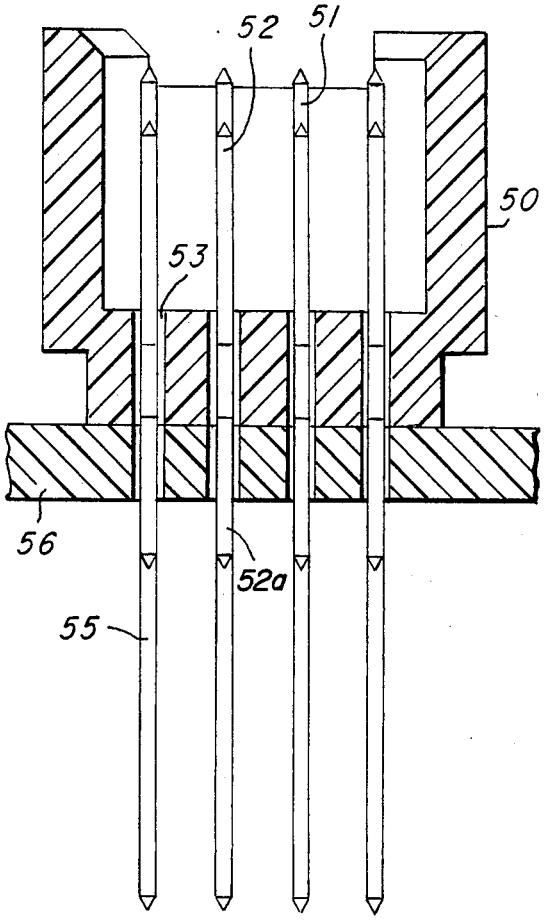
FIGS. 4, 5*a*, and 5*b* illustrate a second embodiment of the invention.
Figure 5A:
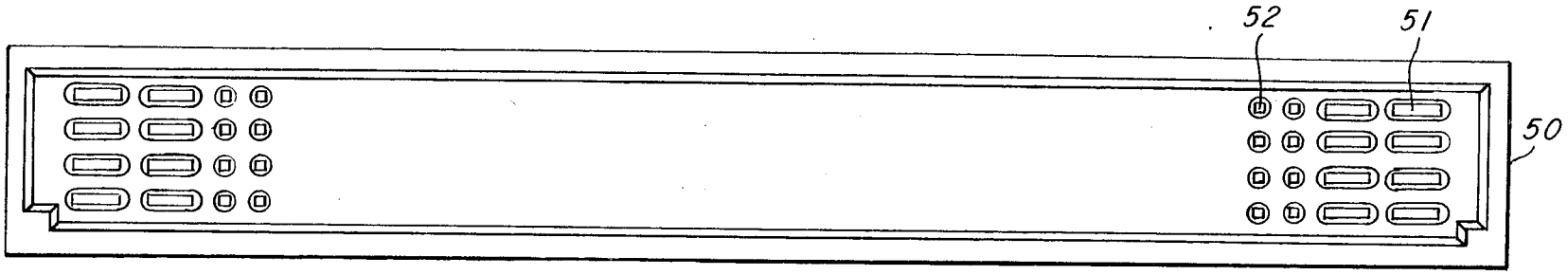
Figure 5B:
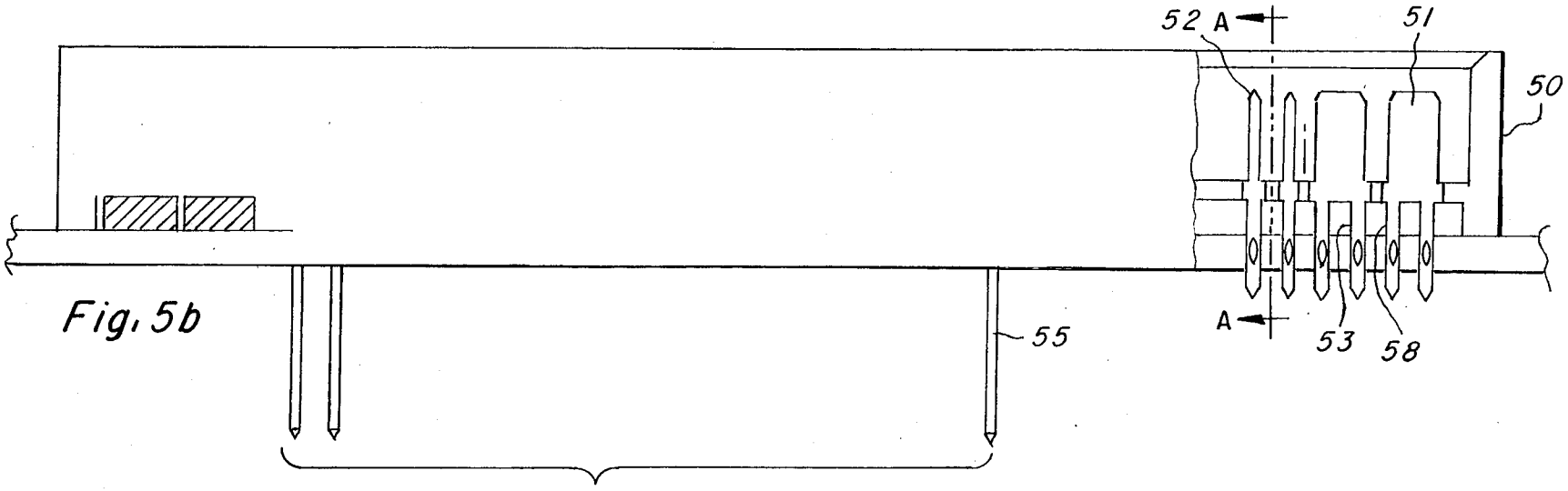

FIG. 4 and FIGS. 5*a* and 5*b* illustrate a connector similar to that shown in FIG. 2 except that there are two rows of power connectors 51. Connector 50 has contacts 51 and 52 extending through openings 53.

The contacts are press fitted into circuit board 56. It should be noted that there are some contacts 52 that have longer tails 55 than the other contacts. The contacts 52 that have short tails, the tails are designated 52*a* (FIG. 5*b*). The tails 55 are optional wire wrap type contacts. As may be seen in FIG. 5*b*, the two rows of power contacts are also press fitted in to buss bars 58.

Figure 6:
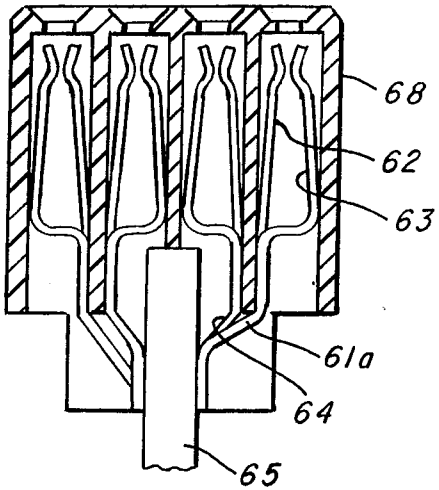

FIGS. 6,7 and 8*a* and 8*b* illustrate a female multi row connector designed to mate with the male connectors described above. There are two different contacts in the connector. FIG. 6 is a cross sectional view of connector 68 taken through section 6—6 of FIG. 8*a*. The section is through the contacts 61*a* and 64. Contact 61, illustrated in FIG. 11, has two parts 62 and 63 which are used to grip and make electrical contact with the contact of the mating connector. Contacts 61 and 64 are similar except that contact 61 is longer since it is in the outer row of connectors and has to be long and off set to one side in order to contact circuit board 65 at a different place that contact 64.

Figure 7:
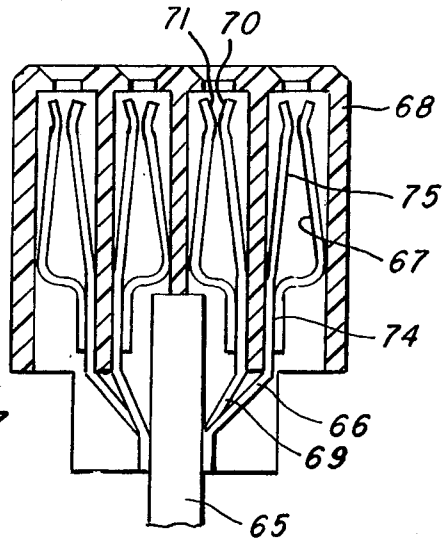
FIGS. 6, 7 8*a* and 8*b* illustrate a female connector of the invention.
Figure 8A:
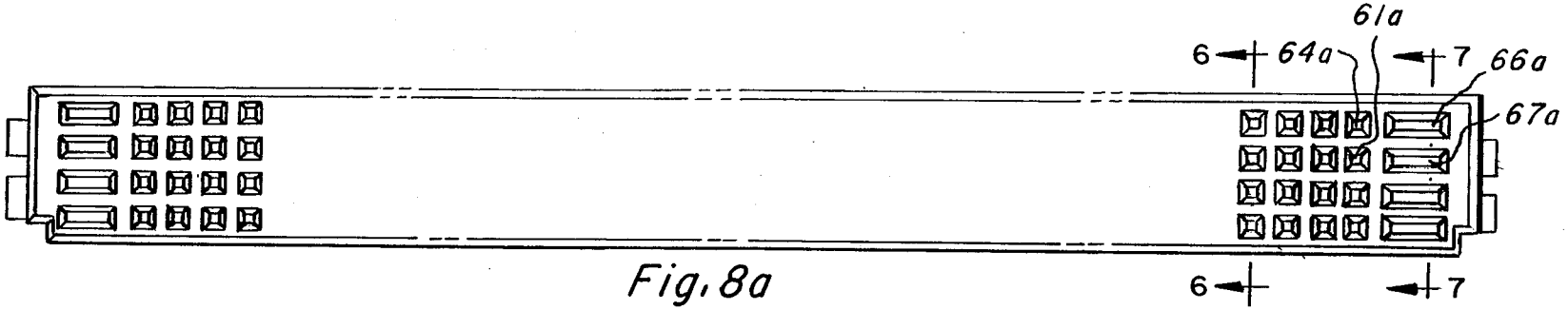
Figure 8B:
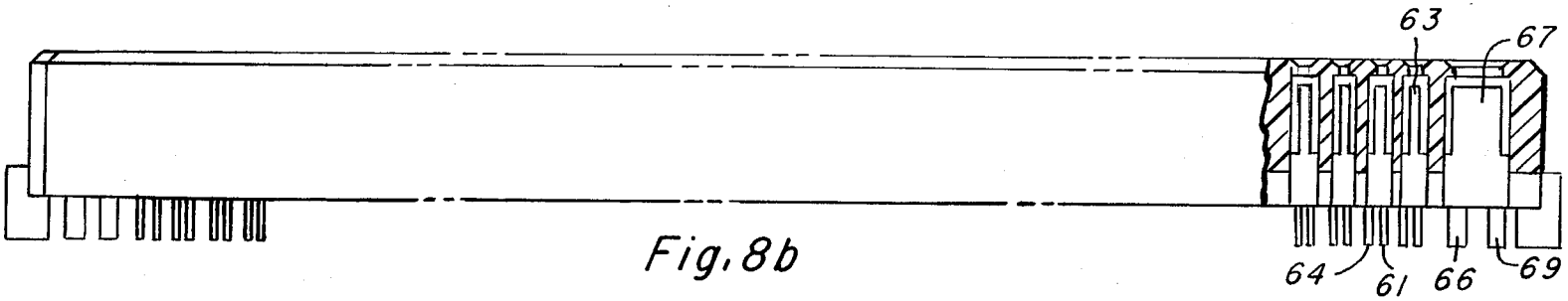

FIG. 7 is a cross section view taken through section 7—7 of FIG. 8*a*. Contacts 66 and 69 are power contacts and are approximately twice the size of contacts 61 and 64 as may be seen in FIGS. 8*a* and 8*b*. Contacts 66 and 69 are made in two parts 71 and 70 (for contact 69) Contact 66 (FIG. 10) is made up of the two parts 67 and 75. The two parts are welded or otherwise bounded at 74. The lower section of part 75 of contact 66 is a flat tab and is used to connect the contact to a conducting region on a printed circuit board edge. The flat tab end 66 of the contact may be flat or bent to conform the end for contacting a printed circuit board. Connector 68 is designed as an card edge connector and as such has contacts that connect to both sides of the printed circuit board.

As illustrated, the power contacts also connected to each side of the circuit board, however the power contact may be provided with press fit ends so that the power contact can be connected to a buss block as illustrated by connector 25 in FIG. 1.

Figure 11:
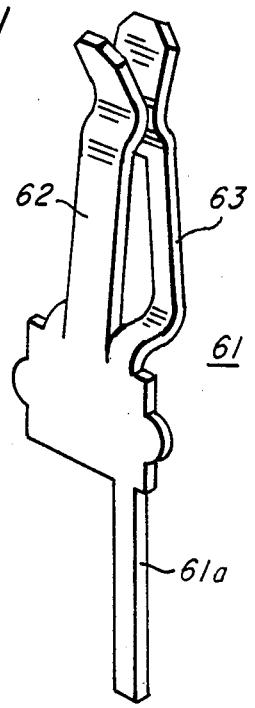
FIG. 11 illustrates a female contact used in a connector of the present invention.
Figure 10:
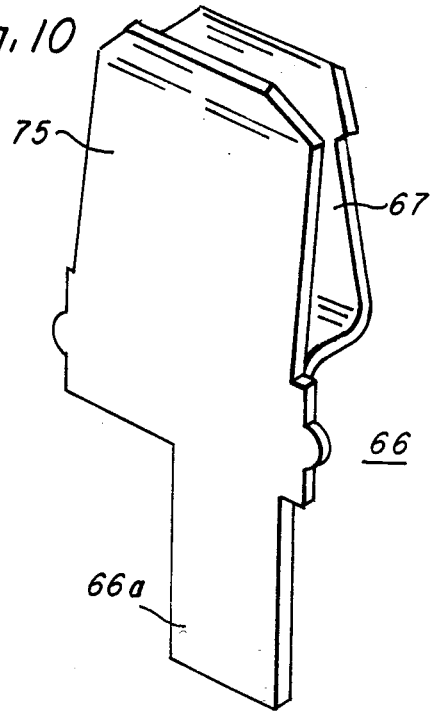
FIG. 10 illustrates a female power contact.
Figure 12:
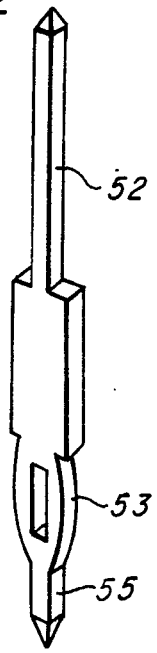
FIG. 12 illustrates a male contact used in a connector of the present invention.
Figure 9:
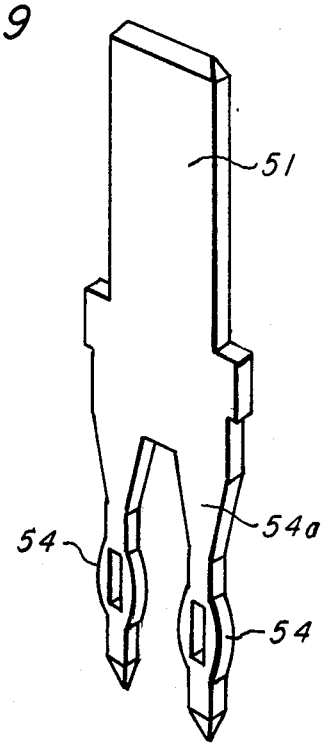
FIG. 9 illustrates one embodiment of a male power contact.

FIGS. 9 and 12 are the male counter parts of the contacts in FIGS. 10 and 11. The male power contact in FIG. 9 has the contact end 51 that is inserted between contacts arms 67 and 75 of contact 66. There are two press fit compliant ends 54 joined to contact end 51 by the wedged shaped section 54*a*. It is the wedged shaped section 54*a* that is press fitted into a buss bar on the surface of a printed circuit board.

FIG. 12 illustrates a male contact that is used in conjunction with the female contact in FIG. 11. The contact includes contact end 52 that mates with contact 61, a press fit compliant section 53*a* and a contact tail 52*a* (or 55 if a long tail is used which may be of a length to which a connection may be wire wrapped.

Examples of male and female power connectors have been given to illustrate one preferred embodiment of the invention, however other embodiments will be suggested to those skilled in the art after reading the above description in conjunction with the claims and drawings, which additional embodiments are deemed to fall within the scope of the following claims.

What is claimed is:

1. A connector combination with a buss bar, the connector including an insulating housing having one or more rows of contacts extending out at least one side of the housing, there being two types of contacts, one enlarged with respect to the other, characterized in that one or more power contacts on each end of the row of contacts is an enlarged contact and has a wedged shaped region on one end of the contact, and that the connector is joined to the buss bar on at least one end of the connector by pressing the end of each power contact having the wedged shaped region into and through holes in the buss bar so that the wedged shaped region is press fitted into holes in the buss bar.

2. A connector for use with a printed circuit board in combination with a buss bar extending under at least one end of the connector, there being at least two different types of contacts in the connector, characterized by a connector housing and first and second contact types, the first contact type being an enlarged contact, with respect to a second contact type, to handle large currents and having a wedged shaped body part press fitted into said buss bar, a second contact type having one end suitable for press fitting into the printed circuit board, and at least one end of the connector housing being adapted for mounting over said buss bar.

* * * * *